United States Patent [19]

Hitchens

[11] Patent Number: 4,562,644

[45] Date of Patent: Jan. 7, 1986

[54] LUBRICANT-APPLYING SAFETY RAZOR

[76] Inventor: Peter B. Hitchens, 2637 Bay St., Charlotte, N.C. 28205

[21] Appl. No.: 639,456

[22] Filed: Aug. 10, 1984

[51] Int. Cl.[4] ..... B26B 21/44

[52] U.S. Cl. ..... 30/41; 30/77

[58] Field of Search ..... 30/41, 90, 77, 79, 80; 83/14

[56] References Cited

U.S. PATENT DOCUMENTS

| | | | |
|---|---|---|---|
| 2,040,345 | 5/1936 | Taylor | 30/77 X |
| 2,327,967 | 8/1943 | Peters | 30/77 |
| 2,677,883 | 5/1954 | Schallgruber | 30/41 |
| 2,861,338 | 11/1958 | Boland | 30/41 |
| 3,382,576 | 5/1968 | Karr | 30/77 X |
| 3,768,161 | 10/1973 | Miller | 30/41 |
| 3,895,437 | 7/1975 | DiBuono | 30/90 |
| 4,074,429 | 2/1978 | Roberts | 30/41 |
| 4,170,821 | 10/1979 | Booth | 30/41 |
| 4,314,404 | 2/1982 | Ruiz | 30/41 |
| 4,381,293 | 4/1983 | Michel | 30/90 X |

*Primary Examiner*—Jimmy C. Peters

*Attorney, Agent, or Firm*—Bell, Seltzer, Park & Gibson

[57] ABSTRACT

The lubricant-applying safety razor includes single or multiple cutting blades supported in a blade-supporting head and a lubricant roll is supported by the blade-supporting head in a position in advance of the cutting edges of the blades when the safety razor is moved along the skin of the user in a shaving motion. The lubricant roll has a peripheral surface for engaging the skin of the user in advance of the cutting edges of the blades and is provided to apply a thin lubricous film to the skin in advance of the cutting edges for the purpose of reducing the coefficient of friction between the wet skin surface and the lubricous film. The peripheral surface of the lubricant roll initially positions the skin surface in a limited angular relationship with the blades. With continued use of the razor, the lubricant roll begins to wear away and thereby lowers so that the angular relationship between the cutting blades and the skin surface gradually increases. After the lubricant roll has been worn away in one fixed position, it may be indexed or rotated to another position to present a new peripheral surface to be engaged by the skin of the user.

8 Claims, 6 Drawing Figures

LUBRICANT-APPLYING SAFETY RAZOR

FIELD OF THE INVENTION

This invention relates generally to a lubricant-applying safety razor and more particularly to such a razor in which a lubricant roll is supported by the head of the razor and immediately in advance of the cutting edge of the blade for applying a lubricous film to the skin. This invention also relates to a safety razor which provides a guide surface positioning the skin surface of the user in a limited yet variable angular relationship with the cutting edge of the blade during the shaving operation.

BACKGROUND OF THE INVENTION

It has long been recognized that the preparation of the beard, or other body hair, for shaving by the application of lathering soap with a brush or a shaving cream rubbed on the skin is expensive and time consuming. Accordingly, it has been proposed that safety razors be provided with various types of lather-applying devices to eliminate the need for the usual beard-conditioning, lather-applying steps prior to shaving. In many instances, these devices have included means for maintaining a supply of lather-applying solution in the handle of the razor and dispensing the lathering material to the skin either prior to or with the shaving strokes of the razor. One such lather-dispensing apparatus is illustrated in U.S. Pat. No. 4,314,404 and includes a foam rubber pad extending outwardly from beneath the cutting edge of the blade and being communicatively connected with a prewetting agent in the handle of the razor.

U.S. Pat. Nos. 2,677,883 and 2,861,338 disclose razor attachments which include rubber rolls carried by the razor and in advance of the cutting edge of the blade for receiving and applying skin moisturizing lather and the like. U.S. Pat. No. 3,895,437 discloses a shaving moisturizer attachment for a razor in which a triangular shaped sponge bar is adjustably supported by the razor for engagement with the skin to apply cream lather or the like to the skin. However, it is to be noted that the lather-applying devices of each of these patents require complicated mounting arrangements and the devices must be supplied with shaving preparations and be properly adjusted, relative to the shaving blade, in order to provide the proper type of lubricant application.

A particular type of shaving composition is disclosed in U.S. Pat. No. 4,381,293. According to this patent the composition may be molded in a variety of different solid forms and is disclosed in one form as being attached to the razor guard of the head of a safety razor. However, the rapid wear rate of this composition prohibits a desirable extended useful life per volume of composition and is therefore considered inadequate as a practical shaving system.

U.S. Pat. No. 4,074,429 discloses an attachment for a safety razor in which a soap cake is supported in advance of the cutting blade for applying a lubricating emulsion to the skin during the shaving operation. However, the use of this type of lather-applying device requires constant attention to and adjustment of the soap cake so that the lubricating emulsion is properly applied to the shaving surface.

SUMMARY OF THE INVENTION

With the foregoing in mind, it is an object of the present invention to provide a lubricant-applying safety razor which is simple in operation, is inexpensive to incorporate in the manufacture of the razor, and which acts as a guide for positioning the skin surface in a limited yet variable angular relationship with the cutting edge of the blade during the shaving operation.

Accordingly, the lubricant-applying safety razor of the present invention includes a lubricant member supported by the blade-supporting head in a position in advance of the cutting edge of the blade when the safety razor is moved along the skin of the user in a shaving motion. The lubricant member is preferably in the form of an elongate cylindrical roll formed essentially of lubricous fatty acids and extending substantially throughout the width of the cutting blade. The lubricant member also includes a peripheral surface for engaging the skin of the user in advance of the cutting edge of the blade in order to apply a thin lubricous film thereto for the purpose of reducing the coefficient of friction between the wet skin surface and the lubricous film. The peripheral surface of the lubricant roll initially positions the skin surface in a particular angular relationship with the cutting edge of the blade. As the peripheral surface of the lubricant member begins to wear away and is lowered with continued use of the razor, the angular relationship between the cutting edge of the blade and the peripheral surface of the lubricant member is gradually increased. The size and positioning of the lubricant roll is calculated so that the angular relationship between the axis of the cutting blade and the peripheral surface of the lubricant roll, hereinafter referred to as the "blade tangent angle," is within a range of 20 to 31 degrees.

In a preferred embodiment, the razor is provided with a pair of shaving blades positioned on the shaving head in such a way as to form an approximate 11 degree angle therebetween. The angular and lateral positions of the blades in the shaving head are arranged relative to the position of the peripheral surface of the lubricant roll to initially guide the skin surface so that shaving is accomplished by the cutting edge of the upper blade only. The blade tangent angle of the upper blade will increase to an angle between 29 and 31 degrees, as a result of the wearing away of the lubricant roll. Shaving is then accomplished for a very short time by the cutting edges of both the upper and lower blades, and with further wear of the lubricant roll, shaving is accomplished by the cutting edge of the lower blade only. This operation of shaving by alternating cutting edges of the upper blade and then the lower blade prolongs the sharpness and useful wear life of the shaving system by maximizing the wear life of each cutting edge as they operate substantially independently of each other.

The lubricant roll is formed around a support shaft which is normally maintained in a non-rotating position between the base and cap member of the blade supporting head. When one portion of the peripheral surface of the lubricating roll has been worn down to a position close to the supporting shaft, the shaft may be rotated or indexed manually to present a new portion of the peripheral surface for engagement with the skin of the user. The purpose of the rotating shaft is to provide the skin surface with the maximum volume of lubricant per given volume in the elongate cylindrical roll.

The support shaft for the lubricant roll is preferably formed of three equally spaced and outwardly extending elongate ribs with spaced-apart openings along the elongate ribs and with the lubricant roll being molded around and between the elongate ribs in order to retain the lubricant roll on the shaft and to prevent rotation of the lubricant roll relative to the shaft. The lubricant roll supporting shaft is normally maintained in a non-rotating position, as by a detent carried by the blade-supporting head and between a pair of adjacent outwardly extending ribs of the shaft. One end of the lubricant roll supporting shaft extends outwardly beyond one side of the blade-supporting head and includes means for manually rotating or indexing the shaft against the resilient biasing of the detent to present a new portion of the peripheral surface of the lubricant roll for engagement by the skin of the user.

BRIEF DESCRIPTION OF THE DRAWINGS

Other objects and advantages will appear as the description proceeds when taken in connection with the accompanying drawings, in which ——

DESCRIPTION OF THE ILLUSTRATED EMBODIMENT

Figure 6:
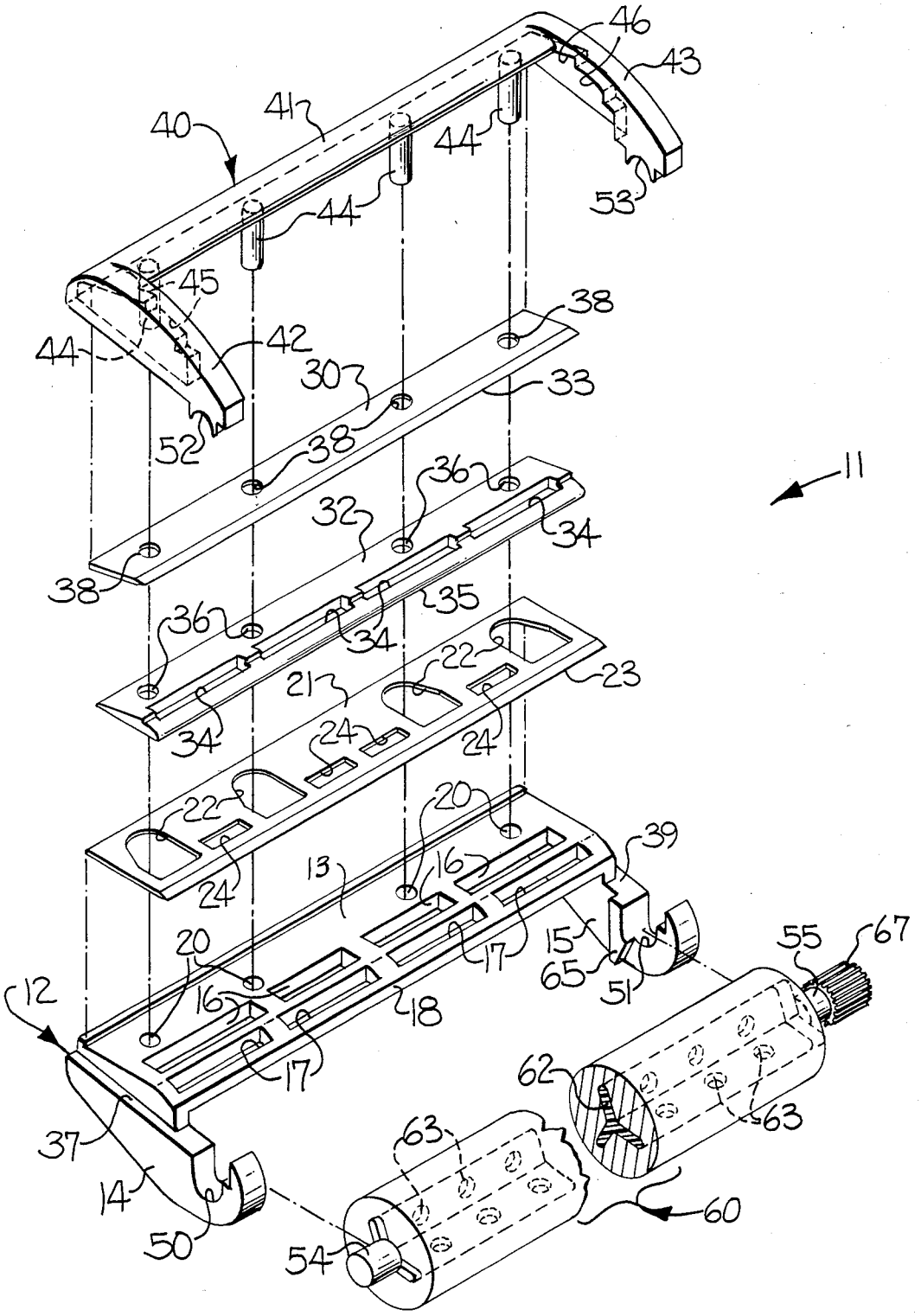
FIG. 6 is an exploded isometric view of the blade supporting head.

The safety razor casing of the present invention is preferably molded of a high-impact polystyrene or other plastic material suitable for mass production means and includes a handle 10 with a blade-supporting head, broadly indicated at 11, supported for limited pivotal movement on the upper end of the handle 10. As best shown in FIG. 6, the blade-supporting head 11 includes a base or platform member, broadly indicated at 12, having an upper planar bridging portion 13 and integrally formed downwardly and forwardly extending opposite end wall members 14, 15. The planar surface 13 is provided with a rear series of four slots 16, a front series of four slots 17, and a forward guard edge 18. A series of four assembly holes 20 is provided rearwardly of the slots 16 and a lower cutting blade 21 is supported on the bridging planar surface 13 of the base or platform member 12. The forward edge of the lower blade 21 is provided with a sharpened edge 23 and a series of four apertures 22 and four slots 24, for purposes to be presently described.

An upper cutting blade 30 is provided with a sharpened edge 33 and is supported with its axis in angular relationship with the axis of the lower blade 21 by a spacer member 32 having a series of four elongate slots 34 disposed rearwardly of a beveled leading guard edge 35. A series of four assembly holes 36 is provided in the spacer member 32 and a series of four aligned holes 38 is provided in the upper blade 30.

A cap member, broadly indicated at 40, includes a transversely extending bridge portion 41 extending between end walls 42, 43 which extend downwardly and forwardly from the bridge portion 41. The upper ends of four assembly pins 44 are integrally formed with the bridging member 41 and extend downwardly therefrom. The assembly pins 44 facilitate proper alignment of the various components and provide a solid one-piece construction when the exploded parts shown in FIG. 6 are assembled. When assembled, the four assembly pins 44 are aligned with the holes 38, 36, 22 and 20 in the respective upper blade 30, spacer member 32, lower blade 21 and bridging portion 13 of the base or platform 12. The end walls 14, 15 of the base member 12 are provided with channels 37, 39 which house the lower edges of the end walls 42, 43 of the cap member 40 after assembly. End walls 42, 43 are provided with respective pairs of grooves 45, 46 (FIG. 6) for positioning and supporting the blades 21, 30 in an approximate 11 degree angular relationship.

The forward portions of the end walls 14, 15 of the base or platform 12 are provided with U-shaped grooves 50, 51. The lower front surfaces of the end walls 42, 43 of the cap member 40 are provided with U-shaped notches 52, 53 (FIG. 6) which fit into the U-shaped grooves 50, 51 when the cap member 40 is assembled on the base or platform 12, as illustrated in dotted lines in FIGS. 4 and 5. The U-shaped grooves and notches provide bearing support openings for opposed shaft end portions 54, 55 of the shaft means thereby supporting a lubricant member, broadly indicated at 60.

The lubricant member 60 is illustrated as being molded in the form of an elongate cylindrical roll having a peripheral surface and a length extending throughout substantially the width of the cutting blades 21, 30. The lubricant roll 60 may be formed of any suitable lubricant material which is capable of being formed or molded into a solid bar or roll and forming a thin lubricous film on the wet skin for reducing the coefficient of friction between the wet skin surface and the lubricous film when the razor is moved along the skin to facilitate shaving. The lubricant roll 60 may be formed of material having a special emulsion and is comprised primarily of water soluble fatty acids including a preservative component, an anticaking component, an emollient or moisturizing agent, and a lubricant component.

It is preferred that the lubricant roll 60 be comprised of an oil-in-water emulsion in which cosmetic lubricants and/or emollients are emulsified by salts of long-chain fatty acids containing straight-chain saturated or unsaturated aliphatic groups of 11 to 13 carbon atoms, and an alkali group consisting of, but not limited to, sodium, ammonium, potassium, monoethanolamine, diethanolamine, or triethanolamine in order to develop a soap emulsifier. In most instances, when a soap is used as the emulsifier in oil-in-water emulsions, it is formed in situ; that is, it is formed during the emulsification process. Usually, the fatty acid is incorporated with the other fatty components, and the alkali of choice is dissolved in the water phase. The two phases are generally heated to 70 to 75 degrees C. and on addition of the oil phase to the water phase (or vice versa) the soap is formed and acts as an emulsifier.

The preferred fatty acid for the present invention is triple-pressed stearic acid due to the high melting point, highly refined quality, and the very hard, extremely white, waxy texture. Also, the alkali of choice is sodium due to the less fluid, more stable soap emulsion formed for solid cosmetic compositions. Because of the higher pH normally associated with a sodium stearate soap, excess fatty acid over alkali is used to neutralize and stabilize the oil-in-water emulsion. This leads to the formation of the "superfatted" soap films around each dispersed oil droplet. These films are composed of alternate molecules of soap and free fatty acid.

In addition, superfatted soap films are highly desirable during the shaving operation because of their non-drying effect of natural oils from the skin. Skin lubricants, moisturizers, and emollients are desirable and therefore are included in the emulsion. Silicone oils, lanolin and lanolin derivatives have been found to be excellent moisturizers and are included in the oil phase of this emulsion. Non-ionic surfactants are usually included in order to improve the emulsion stability of silicone oils and their derivatives.

The shaft means supporting the lubricant roll 60 has suitable means for preventing rotation of the lubricating roll, such as three equally spaced and outwardly extending elongate ribs 62 extending between opposite inner end walls 14, 15 of the forward end of the blade-supporting head 11. Each of the elongate ribs 62 is provided with a series of holes 63 therein to aid in retaining the molded lubricant roll 60 on the elongate ribs 62 and to prevent rotation of the lubricant roll 60 relative to the shaft means. Detent means in the form of an inwardly extending beveled stop member 65 (FIG. 6), is provided on the inner surface of the end wall 15 and extends between the angularly disposed ends of a pair of adjacent ribs 62, as illustrated in dotted lines in FIGS. 4 and 5 to resiliently maintain the shaft means in a normally non-rotating condition.

One end of the shaft means extends outwardly beyond the end wall 15 and includes means, in the form of a knurled or ribbed wheel 67, for manually rotating the shaft means over the resilient biasing of the beveled stop member 65, to present a new peripheral surface of the lubricant roll 60 to be engaged by the skin of the user, in a manner to be presently described. Thus, the lubricant roll 60 is normally maintained in a non-rotating position in advance of the cutting edges 23, 33 of the blades 21, 30. After the peripheral surface of the lubricant roll 60 has been worn away and lowered with continued use of the razor, the roll 60 may be rotated or indexed one-third of a revolution by manual rotation of the wheel 67 to present a new peripheral surface of the lubricant roll 60 for use.

Figure 1:
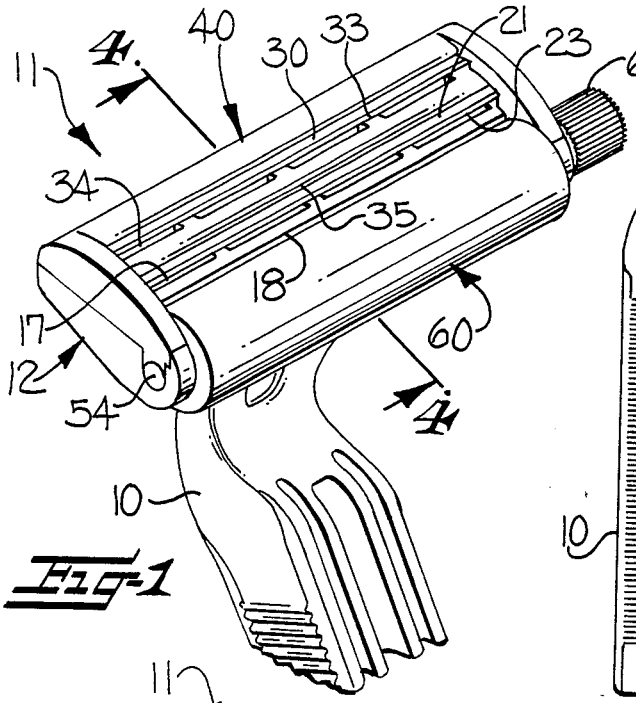
FIG. 1 is an isometric view of the blade-supporting head of the razor of the present invention.
Figure 2:
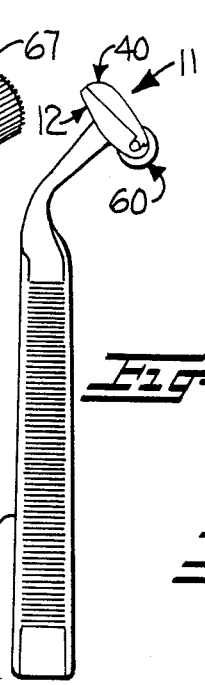
FIG. 2 is a side elevational view of the razor.
Figure 3:
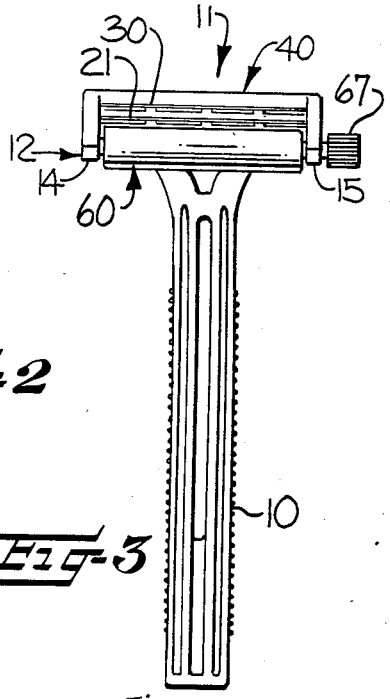
FIG. 3 is a front elevational view of the razor.
Figure 4:
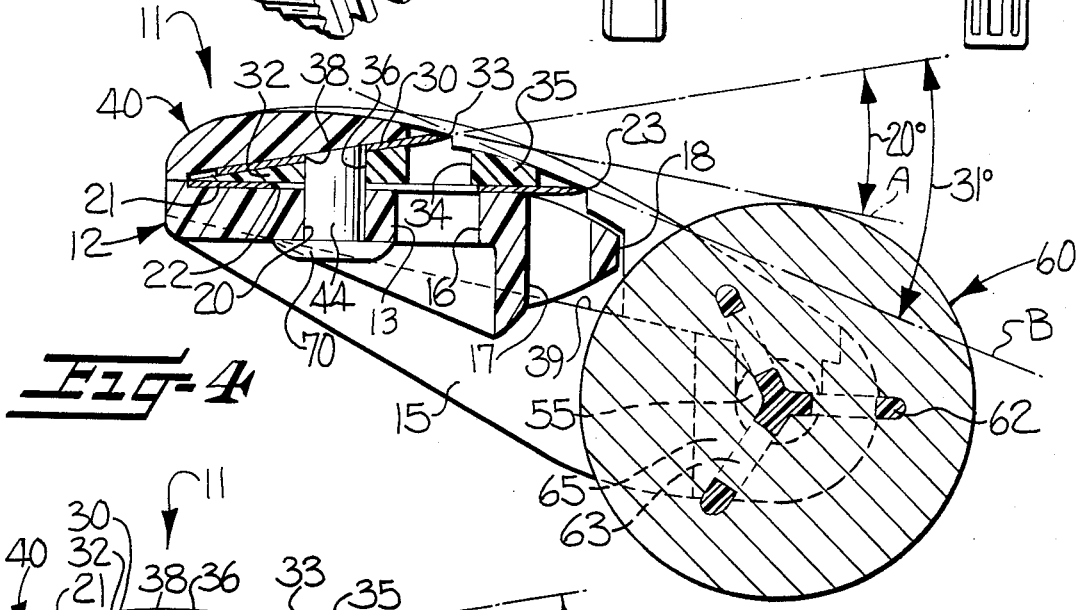
FIG. 4 is an enlarged transverse sectional view through the blade-supporting head, being taken substantially along the line 4—4 in FIG. 1.
Figure 5:
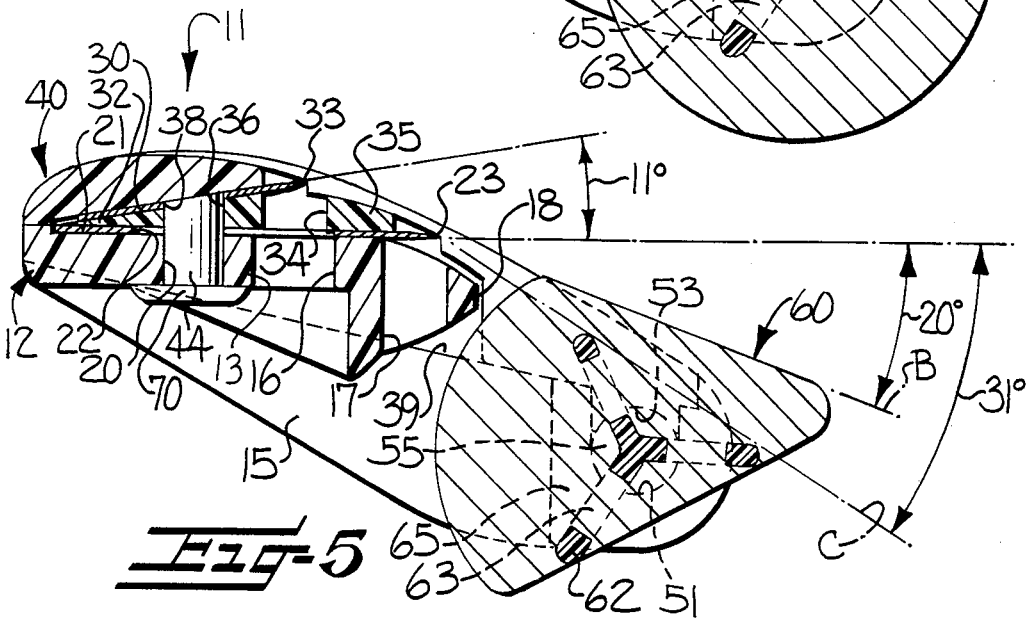
FIG. 5 is a view similar to FIG. 4 but showing the lubricant roll being indexed to a second position and partially worn away.

The razor is capable of mass production assemblage by positioning the parts as illustrated in FIG. 6 and passing the assembly pins 44 through the corresponding holes. Sonic welding is one method used to expand the hollow lower ends of the pins 44 to form retention heads, as indicated at 70 in FIGS. 4 and 5, and thereby maintain the cap member 40 in matched relationship with the base or platform 12 and support the ribs 62 of the shaft means and the lubricant roll 60 in the critical positions shown in FIGS. 4 and 5. In the assembled razor, as illustrated in FIGS. 4 and 5, the lower blade 21 is supported with its cutting edge 23 over the slots 17 and spaced above the guard edge 18 while the cutting edge 33 of the upper blade 30 is supported above the slots 34 in the spacer member 32, the apertures 22 and slots 24 in the blade 21, the slots 16 in the bridging member 13, and slightly rearwardly of the guard edge 35 of the spacer member 32. The slots facilitate the flow of lather, hair stubble and the like away from the shaving zone and also facilitate cleaning of the razor.

Dash-dot axis reference lines are shown in FIGS. 4 and 5 extending along the angular axis of the blades 21, 30, along planes tangent with the peripheral surface of the lubricant roll 60, and along the cutting edges 23, 33 of the blades 21, 30 in order to clearly describe the meaning of the term "blade tangent angle" during various periods of the shaving operation, depending upon the position of the peripheral surface of the lubricant roll 60. As has been explained, the blades 21, 30 are positioned at a particular angular relationship to each other and this angle is illustrated as being 11 degrees in FIG. 5.

When starting the shaving operation with a new lubricant roll 60, the blade tangent angle between the axis of the upper blade 30 and plane A engaging the peripheral surface of the lubricant roll 60 and the cutting edge 33 of blade 30 is shown in FIG. 4 as being 20 degrees. All shaving action during this initial phase of operation will be accomplished by the cutting edge 33 of the upper blade 30 only. The skin will pass over and be supported above the cutting edge 23 of the lower blade 21 until the peripheral surface of the lubricant roll 60 is worn down to plane B in FIGS. 4 and 5, which is tangent with both cutting edges 23, 33 of both blades 21, 30. At this time, a blade tangent angle of 31 degrees is provided with the upper blade 30 and a blade tangent angle of 20 degrees with the lower blade 21, as illustrated in FIGS. 4 and 5.

For a short period of time shaving will be accomplished by both cutting edges 23, 33. With continued shaving, the lubricant roll 60 will be worn away and shaving will then be accomplished by the cutting edge 23 of the lower blade 21 only until the lubricant roll 60 is worn down to a position approximating the outer two surfaces of the ribs 62, as indicated by plane C in FIG. 5. Shaving will be accomplished by the lower cutting edge 23 only as the lower blade tangent angle increases from 20 to 31 degrees, as illustrated in FIG. 5, while the cutting edge 33 of the upper blade 30 is out of engagement with the skin.

Thus, with the lubricant roll support shaft in one position, shaving will initially be accomplished by the cutting edge 33 of blade 30 while the lubricant roll is being worn away with an upper blade tangent angle from 20 degrees to 31 degrees. Shaving will then be accomplished by both blades in order to facilitate a change in cutting edges and avoid an absence of the shaving process. Shaving will then be accomplished by the cutting edge 23 of the lower blade 21 only with a lower blade tangent angle from 20 to 31 degrees, until the lubricant roll 60 is completely worn away in one rotational or indexing position. The lubricant roll 60 may then be rotated or indexed, as indicated in FIG. 5, and a new peripheral surface of the lubricant roll 60 will be presented to guide the skin of the user.

Thus, the lubricant-applying safety razor of the present invention includes a lubricant member, in the form of a solid cosmetic composition, supported in position in advance of the cutting blade means. As the safety razor is moved along the wet skin of the user in a shaving motion, a lubricous film from the lubricant member is applied onto the skin in advance of the cutting blade for reducing the coefficient of friction between the wet skin surface and the lubricous film. The peripheral surface of the lubricant roll also acts as a guide to position the skin surface in a limited yet variable angular relationship with the cutting edge of the blade during the shaving process. As the peripheral surface of the lubricant roll is gradually worn away and lowered during the shaving operation, the angular relationship between the cutting edge and the peripheral surface of the lubricant member gradually increases with use of the razor. The lubricant roll may then be indexed to a new position to present a new peripheral surface to guide the skin of the user.

In the drawings and specification there has been set forth the best mode presently contemplated for the practice of the present invention, and although specific terms and angular relationships are employed, they are used in a generic and descriptive sense only and not for purposes of limitation, the scope of the invention being defined in the claims.

That which is claimed is:

1. A safety razor including a handle, a blade-supporting head carried by one end of said handle, cutting blade means supported in said blade-supporting head, a lubricant member supported by said blade-supporting head in a position in advance of said cutting blade means when said safety razor is moved along the skin of the user in a shaving motion, said lubricant member comprising an elongate cylindrical roll including a peripheral surface for engaging the skin of the user in advance of said cutting blade means and being provided to apply a lubricous film to the skin in advance of said cutting blade means for reducing the coefficient of friction between the wet skin surface and the lubricous film, said peripheral surface having a length extending throughout substantially the width of said cutting blade means and providing a guide surface initially positioning the skin surface of the user in a particular angular relationship with said cutting blade means, said peripheral surface of said lubricant member being frictionally worn away and lowered with continued use of said safety razor so that the blade tangent angle between said cutting blade means and said peripheral surface of said lubricant member is gradually increased within a limited angular range with use of said razor, shaft means extending through the center of said cylindrical lubricant roll, and stop means associated with said shaft means for normally maintaining said cylindrical lubricant roll and said shaft means in a non-rotating position.

2. A safety razor according to claim 1 wherein said stop means comprises detent means carried by said blade-supporting head for engagement with said shaft means and normally preventing rotation of said shaft means and said lubricant cylinder carried thereby.

3. A safety razor according to claim 2 wherein said shaft means includes three equally spaced and outwardly extending elongate ribs extending between opposite inner side portions of said blade-supporting head, said lubricant cylinder being molded around and between said elongate ribs of said shaft means to prevent rotation of said lubricant cylinder relative to said shaft means.

4. A safety razor according to claim 3 wherein said detent means is positioned on the inner surface of one side of said blade-supporting head and extends between the ends of a pair of adjacent of said ribs of said shaft means for resiliently maintaining said shaft means in a normally non-rotating condition.

5. A safety razor according to claim 4 wherein said shaft means extends outwardly beyond the outer surface of one side of said blade-supporting head, and including means carried by the portion of said shaft means extending beyond the outer surface of said one side of said blade-supporting head for manually rotating said shaft means over the resilient biasing of said detent means for presenting a new peripheral surface of said lubricant cylinder to be engaged by the skin of the user.

6. A safety razor including a blade-supporting head, upper and lower successive cutting blades supported in said blade-supporting head with their cutting edges in spaced parallel relationship, a lubricant member supported by said blade-supporting head in a position in advance of said lower cutting blade when said safety razor is moved along the skin of the user in a shaving motion, said lubricant member including a peripheral surface for engaging the skin of the user in advance of said lower cutting blade and being provided to apply a lubricous film to the skin in advance of said lower blade for reducing the coefficient of friction between the wet skin surface and the lubricous film, said peripheral surface provides a guide surface initially extending above a plane tangent with said cutting edge of said lower blade and said guide surface so that the skin is initially engaged by only the cutting edge of said upper cutting blade, said peripheral surface of said lubricant member being frictionally worn away and lowered with continued use of said safety razor so that the skin is engaged by the cutting edges of both of said cutting blades with a predetermined lowering of said peripheral surface of said lubricant member, and so that the skin is engaged by only the cutting edge of said lower cutting blade with an additional predetermined lowering of said peripheral surface of said lubricating member whereby the changing position of the peripheral surface of said lubricant member serves to continuously change the angular position of the skin of the user in relation to the upper and lower cutting blades as lubricant is removed from said peripheral surface of said lubricant member.

7. A safety razor according to claim 6 wherein said lubricant member comprises a solid bar formed of cosmetic grade ingredients having a skin engaging surface adapted to deposit a lubricous film onto the skin surface from said skin engaging surface.

8. A safety razor according to claim 7 wherein said solid bar is round in cross section and is of substantially the same length as the width of said cutting blades.

* * * * *